United States Patent [19]

Asaka et al.

[11] 4,404,934

[45] Sep. 20, 1983

[54] ROTARY VALVE IN AN INTERNAL COMBUSTION ENGINE

[75] Inventors: Urataro Asaka; Noboru Kurata, both of Kami-fukuoka; Masanori Masumura, Sayama, all of Japan

[73] Assignee: Honda Giken Kogyo Kabushiki Kaisha, Tokyo, Japan

[21] Appl. No.: 284,652

[22] Filed: Jul. 20, 1981

Related U.S. Application Data

[63] Continuation of Ser. No. 49,068, Jun. 18, 1979, abandoned.

[30] Foreign Application Priority Data

Jun. 16, 1978 [JP] Japan ..... 53-82722
Jun. 26, 1978 [JP] Japan ..... 53-87815

[51] Int. Cl.[3] ..... F01L 7/10
[52] U.S. Cl. ..... 123/190 BD; 123/80 BA; 123/190 E
[58] Field of Search ..... 123/80 R, 80 BA, 190 R, 123/190 B, 190 BC, 190 BD, 190 BE, 190 BB, 190 BF, 190 E

[56] References Cited

U.S. PATENT DOCUMENTS

| | | | |
|---|---|---|---|
| 985,618 | 2/1911 | Miller | 123/190 BD |
| 1,721,899 | 7/1929 | Doerr | 123/190 E |
| 2,158,386 | 5/1939 | Sykes | 123/190 BD |
| 3,871,340 | 3/1975 | Zimmerman | 123/190 BD |

FOREIGN PATENT DOCUMENTS

| | | | |
|---|---|---|---|
| 82279 | 3/1957 | Denmark | 123/190 E |
| 722270 | 7/1942 | Fed. Rep. of Germany | 123/190 BE |
| 1161027 | 8/1958 | France | 123/80 BA |
| 63415 | 6/1949 | Netherlands | 123/190 E |

*Primary Examiner*—Craig R. Feinberg
*Assistant Examiner*—W. R. Wolfe
*Attorney, Agent, or Firm*—Irving M. Weiner; Pamela S. Burt; John L. Shortley

[57] ABSTRACT

A rotary valve in an internal combustion engine in which the rotary valve proper is formed so as to be hollow and cylindrical and arranged in such a manner that its inner space forms a portion of an intake passage and a portion of an exhaust passage, which portions are separated from each other. In this manner, the valve proper, exhaust passage, and a housing are effectively cooled, and sealing for the rotary valve proper is made effectively and positively.

4 Claims, 4 Drawing Figures

ROTARY VALVE IN AN INTERNAL COMBUSTION ENGINE

This is a continuation of application Ser. No. 49,068 filed June 18, 1979, now abandoned.

The present invention relates to an improvement in a rotary valve which is employed as the rotary intake and exhaust valves in an internal combustion engine.

BACKGROUND OF THE INVENTION

Heretofore, a rotary valve has been known which opens and closes a combustion chamber and intake and exhaust passages with a rotary member instead of valve members of a mushroom-valve type, which known type of valve is employed for the intake and exhaust valves in an internal combustion engine. The rotary valve of such known type results in a plethora of problems, as set forth hereinbelow.

One of the problems attendant such known valve relates to the cooling effect of a rotary valve and a housing thereof. In any conventional valve of this type, an intake passage of the valve proper and the opening thereof, and an exhaust passage and the opening thereof, are respectively separately provided. Taking into account the thermal expansion of, as well as the lubrication between, a housing and the rotary valve proper, the valve proper and a cylinder head forming the housing are cooled by means of water or oil. The sealing surfaces between the elements are also lubricated by means of oil. Consequently, the conventional means has attendant problems such as a complex construction, because it requires a pump for the cooling medium, a pump for the lubricating oil, pipes, members which form a lubricating portion, etc. Thus, the number of components is increased. Further, it is required that the conventional means be provided with means for cooling the lubricating oil.

Another one of the problems attendant the known valve construction relates to a sealing means. A technical difficulty exists in the sealing between opening portions of a valve proper and an opening portion of a combustion chamber. Further difficulties exist in sealing, sticking caused by heat, abrasion, etc., between the valve proper which rotates at a high speed, and the housing. If the sealing is a fixed one, the sticking caused by heat results from distortion of each part due to thermal expansion, and gas leakage is caused thereby. If the sealing is applied only between opening portions of the valve and the combustion chamber, there is a risk of gas leakage. In addition, the rotary valve causes various kinds of problems concerning sealing, for example, against oil leakage and oil entrance upon driving the valve.

The present invention provides a rotary valve structure which eliminates the foregoing problems and shortcomings attendant the conventional means.

SUMMARY OF THE INVENTION

The present invention provides a rotary valve in an internal combustion engine including a rotary valve proper which is arranged in a housing and formed to be of a substantially hollow cylindrical shape. The housing is provided in a cylinder head which includes a combustion chamber. An inner space of the rotary valve proper is arranged to form a portion of an intake passage and a portion of an exhaust passage which are separated from each other and are in selective communication with a combustion chamber as the valve proper rotates.

Accordingly, it is an object of the present invention to provide a rotary valve in an internal combustion engine in which a cooling effect is ensured by an introduction of an air-fuel mixture into an inner space of the valve proper.

Another object of the invention is to provide a rotary valve in an internal combustion engine in which a valve proper as well as a housing thereof are effectively cooled without requiring any additional cooling means. The rotary valve has a simple construction as a result of the above-mentioned cooling effect, so that a cooling by air-cooling as well as intake mixture cooling is attained when the valve is applied to an air-cooling type engine, and that a sealing between the relatively rotating portions can thus be improved.

Another object of the invention is to provide a rotary valve in an internal combustion engine in which intake and exhaust valve actions of the rotary valve system are ensured without any lubrication while the rotary valve and sealing members are prevented from sticking caused by heat.

Another object of the invention is to provide a rotary valve in an internal combustion engine in which a cylindrical valve proper is formed so as to have intake and exhaust passages which each open at an end in the axial direction of the valve proper. The passages also open at the other ends thereof at the outer peripheral portion of the valve proper in such a manner that the openings alternately communicate with a combustion chamber.

Still another object of the invention is to provide a rotary valve in an internal combustion engine in which a sealing for the openings in a radial direction of the valve proper, as well as a side seal in an axial direction, are improved. Thereby, an excellent sealing efficiency is ensured, while compensating for thermal distortion.

Further objects and advantages of the invention will become apparent from the following description, when read in conjunction with the accompanying drawings.

DETAILED DESCRIPTION OF PREFERRED EMBODIMENTS

Figure 1:
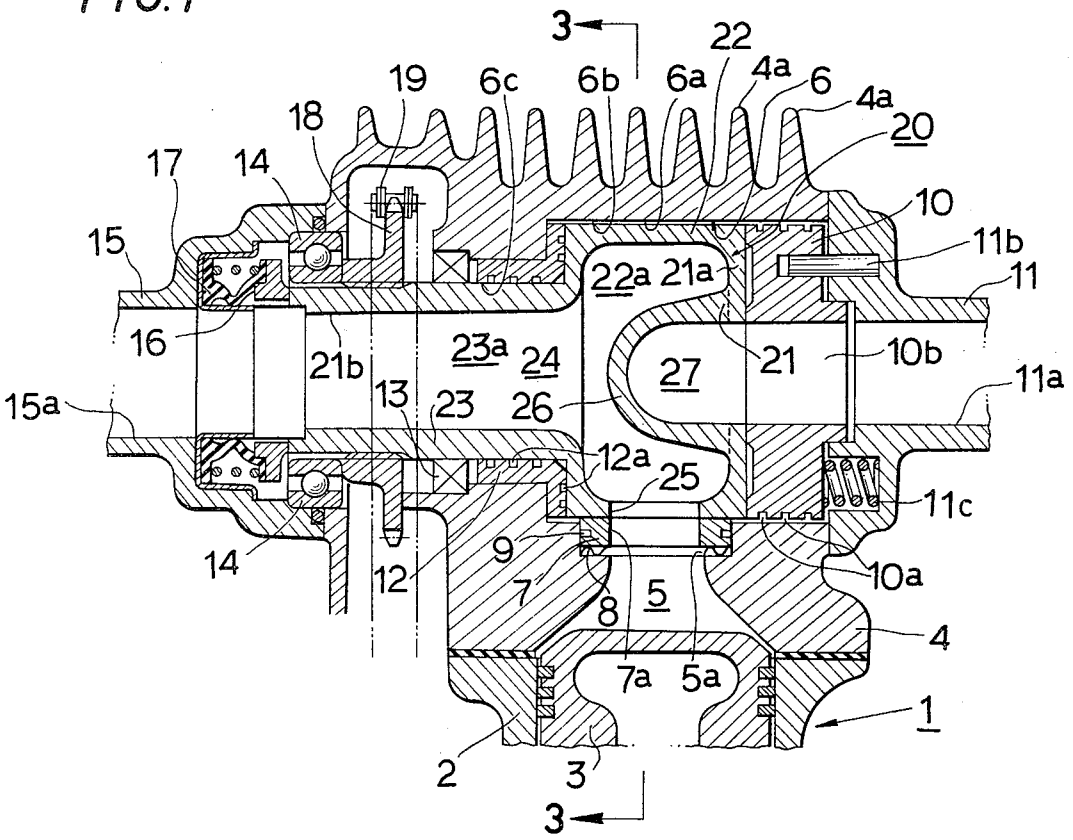
FIG. 1 is a vertical cross-sectional view of an upper portion of an internal combustion engine including a rotary valve in a suction stroke.

In FIG. 1, which shows an arrangement of a rotary valve in a suction stroke, a piston 3 is fitted in a cylinder 2 of an internal combustion engine 1. A rotor housing 4 which constitutes a cylinder head is provided on cylinder 2. Cooling fins **4*a* are provided so as to project from housing 4. A combustion chamber 5 is formed above the piston 3 within housing 4. Above combustion chamber 5 in housing 4 is formed a chamber 6 for a rotary valve, the axis of which extends in a direction perpendicular to an axial direction of cylinder 2 or piston 3. In the embodiment shown, an inner wall 6*a* of chamber 6 includes a large diameter portion 6*b* adapted to directly communicate with combustion chamber 5, and a small diameter portion 6c connected to the portion 6b**.

A valve proper 21 of a rotary valve 20 is rotatably fitted and housed in chamber 6. The rotary valve proper 21, which has a substantially hollow cylindrical shape, is integrally provided with an enlarged diameter portion 22 which conforms to the large diameter portion 6b of chamber 6 at one end, and a small diameter portion 23 which is continuous with enlarged diameter portion 22 and conforms to the small diameter portion 6c of chamber 6. An expanded space 22a within enlarged diameter portion 22 and a spaced 23a within small diameter portion 23 communicate with each other to define a space 24 which extends through the valve proper 21 in the axial direction thereof and forms a portion of an intake passage. The space 22a is closed by a wall 21a at an outer end portion of enlarged diameter portion 22 and the other outer end portion of small diameter portion 23 is open at an end 21b.

Above combustion chamber 5 of housing 4 is formed a concave opening 5a, the diameter of which is larger than the diameter of the upper portion of combustion chamber 5. In opening 5a is slidably interposed a ring-like sealing member 7 which is urged towards the valve proper 21 and pressed so as to be in contact with the outer periphery of the enlarged diameter portion 22 of valve proper 21 by means of a spring member 8, such as a wave spring which is interposed between sealing member 7 and the bottom of concave opening portion 5a. A seal ring 9 is inserted between an outer periphery of sealing member 7 and an inner wall of concave opening portion 5a. The sealing member 7 is formed of ceramics, carbon, or the like, so that no lubricant is required, due to a surface treatment of enlarged diameter portion 22 of valve proper 21 on which member 7 abuts, and because member 7 is provided with a self-lubricating quality and heat-resistance and abrasion-resistance properties. However, a very minimal amount of lubricating oil which is substantially unnecessary to recover may be supplied to a sliding surface or mixed in a fuel.

Figure 3:
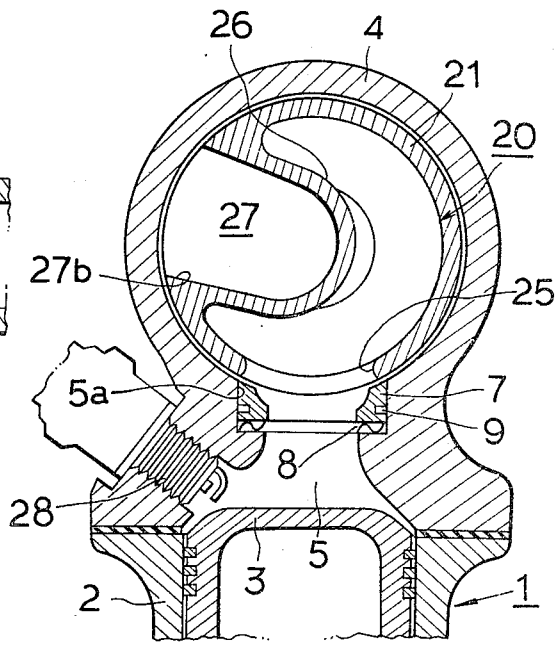
FIG. 3 is a cross-sectional view taken along line 3—3 in FIG. 1.
Figure 2:
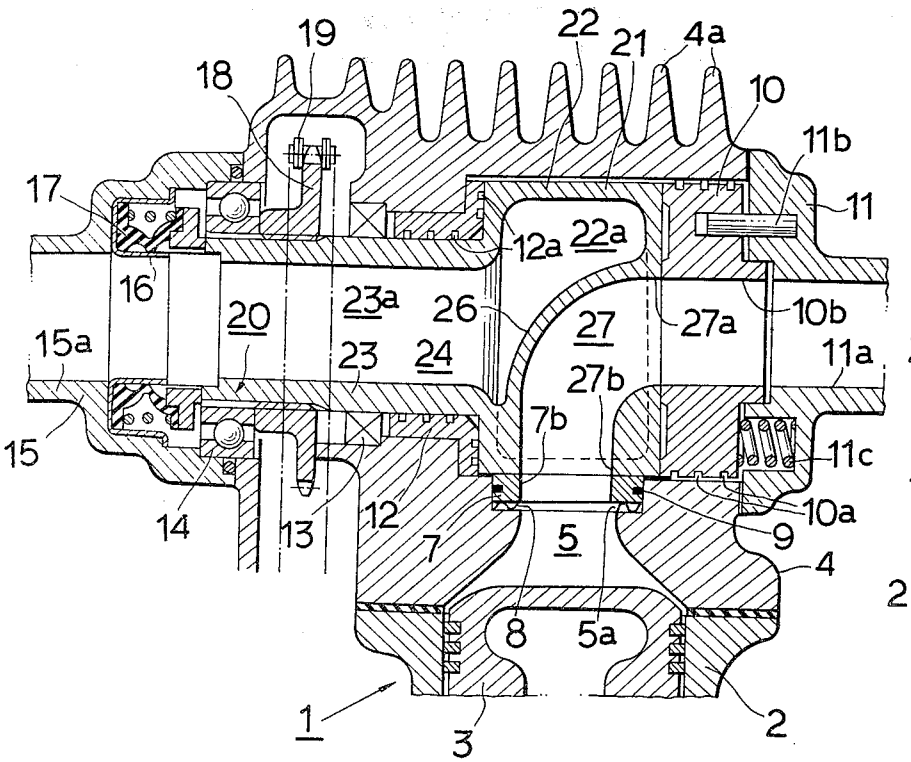
FIG. 2 is a view similar to FIG. 1, showing an exhaust stroke.

At a portion of a peripheral wall of enlarged diameter portion 22 of rotary valve proper 21 is formed an opening 25 comprising a valve opening which corresponds to an opening 7a in sealing member 7. A substantially tubular wall 26 is formed in enlarged diameter portion 22 in such a manner as to divide the expanded space 22a. As clearly shown in FIG. 2, tubular wall 26 is curved and bent to form a substantially curved L-shape and is provided with a communicating exhaust passage 27 therein extending through enlarged diameter portion 22 and separated and sectioned from the expanded space 22a of the intake passage. With such arrangement, the expanded space 22a of the intake passage in the valve proper has disposed therein the exhaust passage 27 confined within tubular wall 26 which has a major proportion of the outer surface thereof exposed to, and extending arcuately into, the interior of the intake passage in the valve proper. One end of passage 27 is open in a position angularly shifted in phase from opening 25 on the same plane in the radial direction of enlarged diameter portion 22. In other words, such one end of passage 27 is shifted by a predetermined angle as shown in FIG. 3 so as to open at an outer peripheral wall of enlarged diameter portion 22 and form an exhaust gas inlet portion 27b. The other end of passage 27 opens in an axial direction at an end wall 21a of enlarged diameter portion 22 so as to form exhaust gas outlet portion 27a (FIG. 2). The outlet portion 27a opens in the axial direction of valve proper 21, and the inlet portion 27b and the opening 25 open in the radial direction of valve proper 21.

At the outer surface of end wall 21a of the enlarged diameter portion 22 of rotary valve proper 21 is provided a side seal 10 formed of ceramics or the like and fitted within the end portion of chamber 6. The outside of side seal 10 is covered with a side cover 11. Between side cover 11 and side seal 10 is interposed a spring member 11c which presses side seal 10 against end wall 21a. The side cover 11 and side seal 10 are joined together by means of a pin 11b and thus restricts rotation of side seal 10. On the outer periphery of side seal 10 is formed labyrinth grooves 10a so as to enhance a sealing effect. A central hole 10b of side seal 10 corresponds to outlet 27a of communicating passage 27. An exhaust passage 11a comprising an exhaust manifold is formed in side cover 11 and is connected to an exhaust pipe (not shown).

The outer surface of an end wall at the other side of enlarged diameter portion 22 is sealingly supported by a bush 12 which includes portions extended radially and axially and which is provided at a stepped portion of valve proper 21 which forms the difference in diameter between portions 23 and 22 thereof. The bush 12 is formed of a material similar to that of side seal 10. Labyrinth grooves 12a are provided at a sliding surface of bush 12 on the outer peripheral wall of small diameter portion 23 of valve proper 21, as well as at a sliding surface of bush 12 on the outer end surface of enlarged diameter portion 22. An oil seal 13 is provided adjacent to bush 12 on portion 23 of valve proper 21. A bearing 14 is provided on the outer periphery of the open end 21b of valve proper 21 so as to support the small diameter portion 23. At the open outer end of small diameter portion 23 is provided a side cover 15 forming an inlet manifold. The open end 21b of small diameter portion 23 communicates with an intake passage 15a. Between side cover 15 and open end 21b of small diameter portion 23 are interposed a slidable seal member 16 and a sealing spring member 17 to apply sealing.

Between oil seal 13 and bearing 14 is provided a sprocket 18 which is connected with a crank shaft of an engine, for example, by means of a chain 19 so as to rotatingly drive the valve proper 21.

The rotary valve proper 21 is rotated and driven by means of chain 19 and sprocket 18. Suction and exhausting of gas is effected only when the openings 25 and 27b on the large diameter portion 22 are individually respectively aligned with the opening 7a of seal member 7 provided above combustion chamber 5. The opening 7a is closed by the outer peripheral wall of enlarged diameter portion 22 in any other compression and expansion strokes. The sealing efficiency between valve 20 and housing 4 is enhanced by seal member 7, side seal 10, bush 12 and labyrinth grooves 10a and 12a. Lubricating oil for chain 19 and sprocket 18 is prevented from entering the valve side by oil seal 13.

In the suction stroke arrangement shown in FIG. 1, a mixture flows through intake passage 15a, the seal members 16 and 17, the open end 21b of valve proper 21, the space 23a within small diameter portion 23, and the space 22a within enlarged diameter portion 22, and thereafter is introduced into the combustion chamber 5 through the opening 25 and 7a. In the embodiment shown, the expanded space 22a, which is of a larger diameter than that of space 23a, is arranged adjacent to combustion chamber 5, and thus an introduced fuel is stored in space 22*a* which functions as a pressure chamber in the suction stroke. Suction efficiency is thus prevented from lowering due to a duct resistance or the like, and such efficiency is substantially enhanced.

On the other hand, in an exhausting stroke as shown in FIG. 2, the inlet 27*b* of exhaust passage 27 communicates with combustion chamber 5 and an exhaust gas is exhausted via passages 10*b*, 11*a* which continuously communicate with outlet portion 27*a*.

In the above, the space 24 in valve proper 21 forms a part of the intake passage and is defined in the interior of the entire valve proper 21, which is cylindrical. Consequently, a cooling of at least the valve proper 21 is effected well by means of a mixture introduced in space 24. The exhaust passage 27 is formed so as to be separated and sectioned from space 24 by tubular wall 26, and is arranged along the entire length thereof adjacent space 24. Therefore, the passage 27 defined by tubular wall 26 is cooled by the introduced mixture. In other words, the rotary valve and its adjacent parts are cooled without providing special separate cooling means therefor, except for cooling fins 4*a*, according to the illustrated embodiment, which ensure still further cooling effects. In FIG. 3, an ignition plug 28 is also shown.

Figure 4:
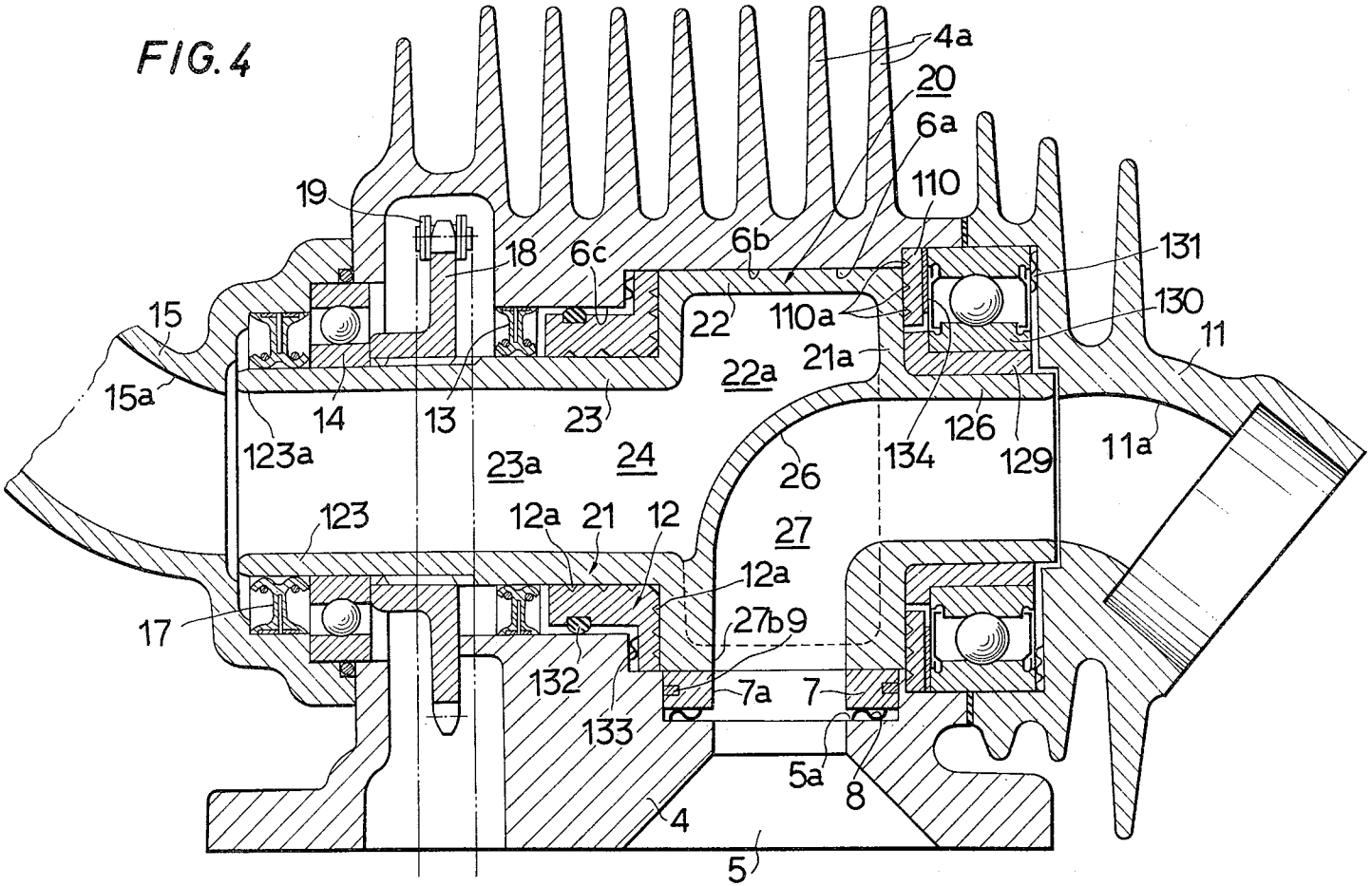
FIG. 4 is a view similar to FIG. 3, showing a modified embodiment including an improvement in a sealing means.

In the modified embodiment of the invention shown in FIG. 4, the basic structure thereof is substantially the same as that of the previously described embodiment, and accordingly like reference numerals are employed to designate like components. In FIG. 4, tubular wall 26 extends from the outlet end 27*a* of passage 27 in the axial direction in a tubular shape. An end face of the extended portion 126 abuts against the passage 11*a* of side cover 11. A heat-insulating bush 129 which is tubular in shape and is provided at its proximal end with a flange shaped portion is provided in such a manner that it extends over an entire outer periphery of extended portion 126 and over a portion of an end surface of end wall 21*a*. A bearing 130 is provided at an outer periphery of heat-insulating bush 129. Between an outer end surface of bearing 130 and an end surface of side cover 11 which faces bearing 130 is interposed a resilient element 131 so as to press bearing 130 against end wall 21*a*. Between an inner end surface of bearing 130 and end wall 21*a* is interposed a ring-like side sealing member 110 supported by a thrust washer 134. Labyrinth grooves 110*a* are formed at an end surface of member 110 at the side of end wall 21*a*. An open end portion of small diameter portion 23 of valve proper 21 is extended to form an extended portion 123 having an end opening 123*a* which connects with the intake passage 15*a* of side cover 15. Thus, the seal member 16 required in the previous embodiment is eliminated, and the oil seal 17 is so arranged as to be in direct contact with an outer periphery of extended portion 123. Furthermore, an O-ring 132 is provided at an outer peripheral portion of seal member 12 so as to enhance the sealing efficiency. Seal member 12 is pressed against an end wall of enlarged diameter portion 22 of valve proper 21 by means of a resilient element 133.

The second embodiment of the invention (shown in FIG. 4) ensures a cooling effect similar to that provided by the first embodiment, as well as a high sealing effect.

In each of the above described embodiments, it is sufficient that the valve proper is hollow and cylindrical, and the invention is not limited to a valve proper having different diameter portions.

Although there have been described what are at present considered to be the preferred embodiments of the invention, it will be understood that various modifications may be made therein without departing from the spirit or essential characteristics thereof. The present embodiments are therefore to be considered in all respects as illustrative, and not restrictive. The scope of the invention is indicated by the appended claims rather than by the foregoing description.

We claim:

1. A rotary valve in an internal combustion engine, comprising:

a rotary valve proper arranged in a housing and having a substantially hollow cylindrical shape, said valve proper including a small diameter portion and an enlarged diameter portion;

said housing being provided in a cylinder head including a combustion chamber;

an inner space of said rotary valve proper being arranged to form a portion of an intake passage and a portion of an exhaust passage;

said portion of said intake passage in said valve proper including an expanded space arranged in said enlarged diameter portion of said valve proper and having a larger diameter than the diameter of the residual space in said portion of said intake passage;

said expanded space being disposed adjacent to said combustion chamber;

said portion of said intake passage and said portion of said exhaust passage being separated from each other and including end openings which selectively communicate with said combustion chamber as said valve proper rotates, said end openings being angularly shifted from each other on the same plane in the radial direction of said valve proper;

said portion of said intake passage and said portion of said exhaust passage including other end openings opened respectively at axial ends of said valve proper;

a substantially tubular wall having said portion of said exhaust passage confined therein, said tubular wall having a major proportion of the outer surface thereof exposed to and extending arcuately into the interior of said expanded space of said portion of said intake passage such that said portion of said exhaust passage is disposed substantially within said expanded space of said portion of said intake passage;

a bush means provided with radial and axial extensions, said bush means being arranged on said valve proper at a stepped portion between said small diameter portion and said enlarged diameter portion;

said radial and axial extensions of said bush means being in slidable contact with an end surface of said enlarged diameter portion and an outer peripheral surface of said small diameter portion, respectively;

an O-ring provided at an outer peripheral portion of said axial extension of said bush means;

means for driving said rotary valve, said driving means being provided on said small diameter portion; and an oil seal means disposed between said driving means and said bush means.

2. A rotary valve according to claim 1, wherein:

said small diameter portion of said rotary valve proper communicates at an open end thereof with an inlet manifold; and an oil seal is arranged around said small diameter portion adjacent said inlet manifold.

3. A rotary valve in an internal combustion engine, comprising:

a rotary valve proper arranged in a housing and having a substantially hollow cylindrical shape, said valve proper including a small diameter portion and an enlarged diameter portion;

said housing being provided in a cylinder head including a combustion chamber;

an inner space of said rotary valve proper being arranged to form a portion of an intake passage and a portion of an exhaust passage;

said portion of said intake passage in said valve proper including an expanded space arranged in said enlarged diameter portion of said valve proper and having a larger diameter than the diameter of the residual space in said portion of said intake passage;

said expanded space being disposed adjacent to said combustion chamber;

said portion of said intake passage and said portion of said exhaust passage being separated from each other and including end openings which selectively communicate with said combustion chamber as said valve proper rotates, said end openings being angularly shifted from each other on the same plane in the radial direction of said valve proper;

said portion of said intake passage and said portion of said exhaust passage including other end openings opened respectively at axial ends of said valve proper;

a substantially tubular wall having said portion of said exhaust passage confined therein, said tubular wall having a major proportion of the outer surface thereof exposed to and extending arcuately into the interior of said expanded space of said portion of said intake passage such that said portion of said exhaust passage is disposed substantially within said expanded space of said portion of said intake passage;

a bush means provided with radial and axial extensions, said bush means being arranged on said valve proper at a stepped portion between said small diameter portion and said enlarged diameter portion;

said radial and axial extensions of said bush means being in slidable contact with an end surface of said enlarged diameter portion and an outer peripheral surface of said small diameter portion, respectively; and an O-ring provided at an outer peripheral portion of said axial extension of said bush means.

4. A rotary valve according to claim 3, wherein:

said small diameter portion of said rotary valve proper communicates at an open end thereof with an inlet manifold; and an oil seal is arranged around said small diameter portion adjacent said inlet manifold.

* * * * *